US006691515B2

(12) United States Patent
Verdouw et al.

(10) Patent No.: US 6,691,515 B2
(45) Date of Patent: Feb. 17, 2004

(54) DRY LOW COMBUSTION SYSTEM WITH MEANS FOR ELIMINATING COMBUSTION NOISE

(75) Inventors: Albert J. Verdouw, Indianapolis, IN (US); Duane Smith, Carmel, IN (US); Keith McCormick, Indianapolis, IN (US); Mohan K. Razdan, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 0 days.

(21) Appl. No.: 10/096,230

(22) Filed: Mar. 12, 2002

(65) Prior Publication Data

US 2003/0172655 A1 Sep. 18, 2003

(51) Int. Cl.[7] ..... F23R 3/34
(52) U.S. Cl. ..... 60/737; 60/39.37; 60/39.465
(58) Field of Search ..... 60/737, 39.37, 60/39.465, 748

(56) References Cited

U.S. PATENT DOCUMENTS

| | | | | |
|---|---|---|---|---|
| 3,779,695 A | * | 12/1973 | Chamberlain | 431/351 |
| 4,263,780 A | * | 4/1981 | Stettler | 60/39.23 |
| 4,399,652 A | | 8/1983 | Cole et al. | 60/39.465 |
| 4,796,429 A | | 1/1989 | Verdouw | 60/751 |
| 5,319,923 A | | 6/1994 | Leonard et al. | 60/39.23 |
| 5,319,935 A | | 6/1994 | Toon et al. | 60/733 |
| 5,387,081 A | | 2/1995 | LeBlanc | 415/208.1 |
| 5,394,688 A | | 3/1995 | Amos | 60/39.23 |
| 5,408,825 A | | 4/1995 | Foss et al. | 60/39.463 |
| 5,473,881 A | | 12/1995 | Kramnik et al. | 60/39.02 |
| 5,479,782 A | | 1/1996 | Parker et al. | 60/747 |
| 5,628,182 A | | 5/1997 | Mowill | 60/39.36 |
| 5,628,192 A | | 5/1997 | Hayes-Bradley et al. | 60/733 |
| 5,647,215 A | | 7/1997 | Sharifi et al. | 60/737 |
| 5,657,632 A | | 8/1997 | Foss | 60/742 |
| 5,664,412 A | | 9/1997 | Overton | 60/39.23 |
| 5,797,267 A | * | 8/1998 | Richards | 60/737 |
| 5,813,232 A | | 9/1998 | Razdan et al. | 60/737 |
| 5,816,050 A | | 10/1998 | Sjunnesson et al. | 60/748 |
| 5,987,889 A | | 11/1999 | Graves et al. | 60/748 |
| 6,094,916 A | | 8/2000 | Puri et al. | 60/737 |
| 6,151,899 A | | 11/2000 | Park | 60/748 |
| 6,289,676 B1 | | 9/2001 | Prociw et al. | 60/740 |
| 6,532,742 B2 | * | 3/2003 | Scarinci et al. | 60/725 |

OTHER PUBLICATIONS

Summerfield et al., *Mechanical Design and Development of the RB211 Dry Low Emissions Engine*, The American Society of Mechanical Engineers, 93–GT–245.

Willis et al., *Industrial RB211 Dry Low Emission Combustion*, The American Society of Mechanical Engineers, 93–GT–391.

* cited by examiner

*Primary Examiner*—Ehud Gartenberg
(74) *Attorney, Agent, or Firm*—Woodward, Emhardt, Moriarty, McNett & Henry LLP

(57) ABSTRACT

A combustion system including a plurality of axially staged tubular premixers to control emissions and minimize combustion noise. The combustion system includes a radial inflow premixer that delivers the combustion mixture across a contoured dome into the combustion chamber. The axially staged premixers having a twist mixing apparatus to rotate the fluid flow and cause improved mixing without causing flow recirculation that could lead to pre-ignition or flashback.

38 Claims, 8 Drawing Sheets

DRY LOW COMBUSTION SYSTEM WITH MEANS FOR ELIMINATING COMBUSTION NOISE

The present invention was made under contract DE-FC21-96-MC33066 awarded by the United States Department of Energy. The United States Department of Energy may have rights in the invention

BACKGROUND OF THE INVENTION

The present invention relates generally to gas turbine engine combustors, and more particularly, in one form, to a dry low emission combustion system that utilizes swirling and jet flows within the combustion chamber to provide stable aerodynamics.

Air pollution emissions are an undesirable by-product from the operation of a gas turbine engine that burns fossil fuels. The primary air polluting emissions produced by the burning of fossil fuels include carbon dioxide, water vapor, oxides of nitrogen, carbon monoxide, unburned hydrocarbons, oxides of sulfur and particulate. Of the above emissions, carbon dioxide and water vapor are generally not considered objectionable. However, air pollution has become a worldwide concern and many nations have enacted stricter laws regarding the discharge of pollutants into the environment.

Gas turbine engine designers have generally accepted that many of the by-products of the combustion of fossil fuel can be controlled design parameters, the cleanup of exhaust gases and regulating the quality of fuel. Oxides of Nitrogen ($NO_x$) are one the pollutants that have been of particular concern to gas turbine engine designers. It is well known that in a gas turbine engine the oxidation of nitrogen is dependent upon the flame temperature within the combustion region. Many industrial gas turbine engines utilize premixing of the fuel with the compressor air to create a reactant mixture with lean stoichiometries to limit flame temperature and control $NO_x$ formation. Typically, a premixing section within the combustor prepares a combustible mixture upstream of the flame front, and therefore the combustor includes provisions to keep the flame from entering or igniting within the premixing section. Often the residence time and velocities within the premixing section are manipulated to discourage auto-ignition and flashback. As a result of this manipulation the residence time is many times limited, which results in incomplete mixing with increased $NO_x$ emission. Further, in many systems the burning temperatures are low enough that Carbon Monoxide (CO) emissions are increased.

A limitation associated with many prior dry low emission combustion systems is that they have tended to have combustion instability, which is manifested as noise. It appears that combustion instability results from a coupling of the combustion process with acoustical characteristics of the system. The associated resonances affect combustor performance and can quickly build to destructive levels. Many of the approaches to date for addressing the limitations of the prior dry low emission combustion systems have generally had limited success or caused a reduced system performance. The present invention satisfies the technological needs for combustion systems in a novel and unobvious way.

SUMMARY OF THE INVENTION

One form of the present invention contemplates a combustor for burning a fuel and gas mixture, comprising: a mechanical housing; a combustion chamber located within the mechanical housing and having a first end and a second end and an internal volume; a radial inflow swirler located at the first end and disposed in flow communication with the internal volume, the radial inflow swirler including a plurality of fuel dispensers for delivering the fuel into the gas within the swirler and a plurality of vanes for directing the fuel and gas flow into the internal volume to define a swirler flow; and, a first plurality of tubular premixers connected to the combustion chamber and in flow communication with the internal volume, each of the first plurality of tubular premixers deliver a premixed jet flow of the gas and fuel into the internal volume.

Another form of the present invention contemplates a combustor, comprising: a mechanical housing; a combustion chamber disposed within the mechanical housing and having a first end and a second end and an internal volume; a premixer coupled to the first end of the combustion chamber and in flow communication with the internal volume, the premixer including a swirler that delivers a swirling flow of fuel and gas to the internal volume through the first end; and, a dome positioned at the first end of the combustion chamber and extending into the internal volume, the dome having an outer surface contoured to minimize flow separation of the swirling flow of fuel and gas passing from the premixer and into the combustion chamber.

Another form of the present invention contemplates a combustor, comprising: a mechanical housing; a combustion chamber located within the mechanical housing and having a first end and a second end and an internal volume; a premixer coupled to the first end of the combustion chamber and in flow communication with the internal volume, the premixer including a swirler that delivers a swirling flow of fuel and gas to the internal volume through the first end; and, a dome located at the first end and within the internal volume of the combustion chamber, the dome extending along the circumference of the first end and having a convex cross-section.

Yet another form of the present invention contemplates a combustor, comprising: a cylindrical combustor chamber having a first end, a second end and an internal volume, the combustor chamber having a portion with a constant cross-sectional area, the combustor chamber having a plurality of first apertures in the portion and a plurality of second apertures in the portion, and the plurality of first apertures are axially spaced from the plurality of second apertures; a plurality of first tubular premixers are coupled to the combustor chamber, each of the plurality of first tubular premixers is in flow communication with one of the plurality of first apertures; and, a plurality of second tubular premixers coupled to the combustor chamber, each of the plurality of second tubular premixers is in flow communication with one of the plurality of second apertures.

In yet another form the present invention contemplates a combustor, comprising: a mechanical housing; a combustion chamber located within the mechanical housing and having an internal volume; and, a premixer coupled with the combustion chamber, the premixer comprising: a tubular member having a first end and a second end and a flow passageway therebetween; a fuel manifold disposed in fluid communication with the flow passageway for the delivery of a fuel into the flow passageway; and, twist mixer means for rotating the fluid flowing within the flow passageway, the twist mixer means positioned within the flow passageway.

In yet another form the present invention contemplates a combustor for burning a fuel and air mixture. The combustor, comprising: a combustor liner having a fist end, a second end and an internal volume; a premixer coupled to the first end of the combustor liner and disposed in flow communication with the internal volume, the premixer including a radial inflow swirler having a plurality of fueling passages for delivering the fuel into the air within the swirler and a plurality of vanes for directing the fuel and air flow from the premixer; a center body having at least a portion positioned within the premixer and located within a space defined between the plurality of vanes; a dome disposed between the first end of the combustor liner and the premixer, the dome having an outer surface contoured to minimize flow separation of the fuel and air flowing from the premixer into the internal volume; a plurality of first tubular premixers coupled to the combustor liner, each of the plurality of first tubular premixers in flow communication with the internal volume; and, a plurality of second tubular premixers coupled to the combustor liner, each of the plurality of second tubular premixers is in flow communication with the internal volume, and the plurality of second tubular premixers are spaced axially from the plurality of first tubular premixers.

One object of the present invention is to provide a unique combustion system.

Related objects and advantages of the present invention will be apparent from the following description.

DESCRIPTION OF THE PREFERRED EMBODIMENTS

Figure 1:
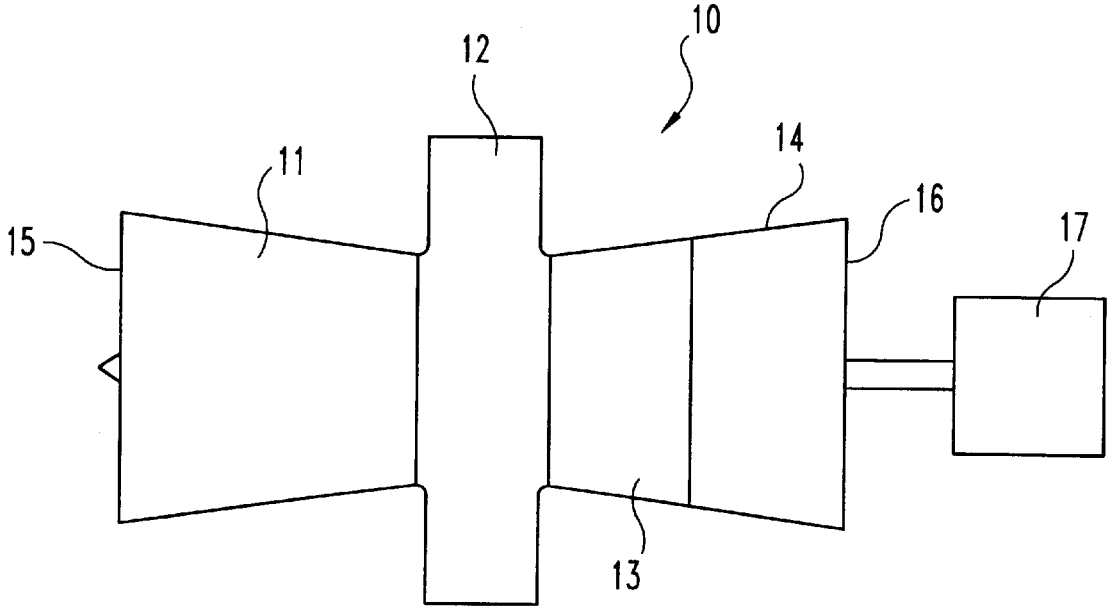
FIG. 1 is an illustrative view of a gas turbine engine including a combustion system comprising one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

With reference to FIG. 1, there is illustrated an industrial gas turbine engine 10 comprising a compressor section 11, a combustion section 12, a turbine section 13 and a power turbine section 14. The industrial gas turbine engine 10 includes an inlet 15 for receiving a flow of air and an exhaust 16. The turbine section 13 is configured to drive the compressor section 11 via one or more shafts (not illustrated). The power turbine section 14 is arranged to drive an auxiliary device 17. Auxiliary devices include an electric generator or other devices known to be powered by industrial gas turbine engines. It is important to realize that there are a multitude of ways in which the components can be linked together. Additional compressors and turbines could be added with intercoolers connecting between the compressors and reheat combustion chambers could be added between the turbines. The present inventions are designed to be utilized in a wide variety of gas turbine engines and are not intended to be limited to the engines illustrated herein unless specifically provided to the contrary. The general operation of the gas turbine engine 10 is quite conventional and will not be discussed further.

Figure 2:
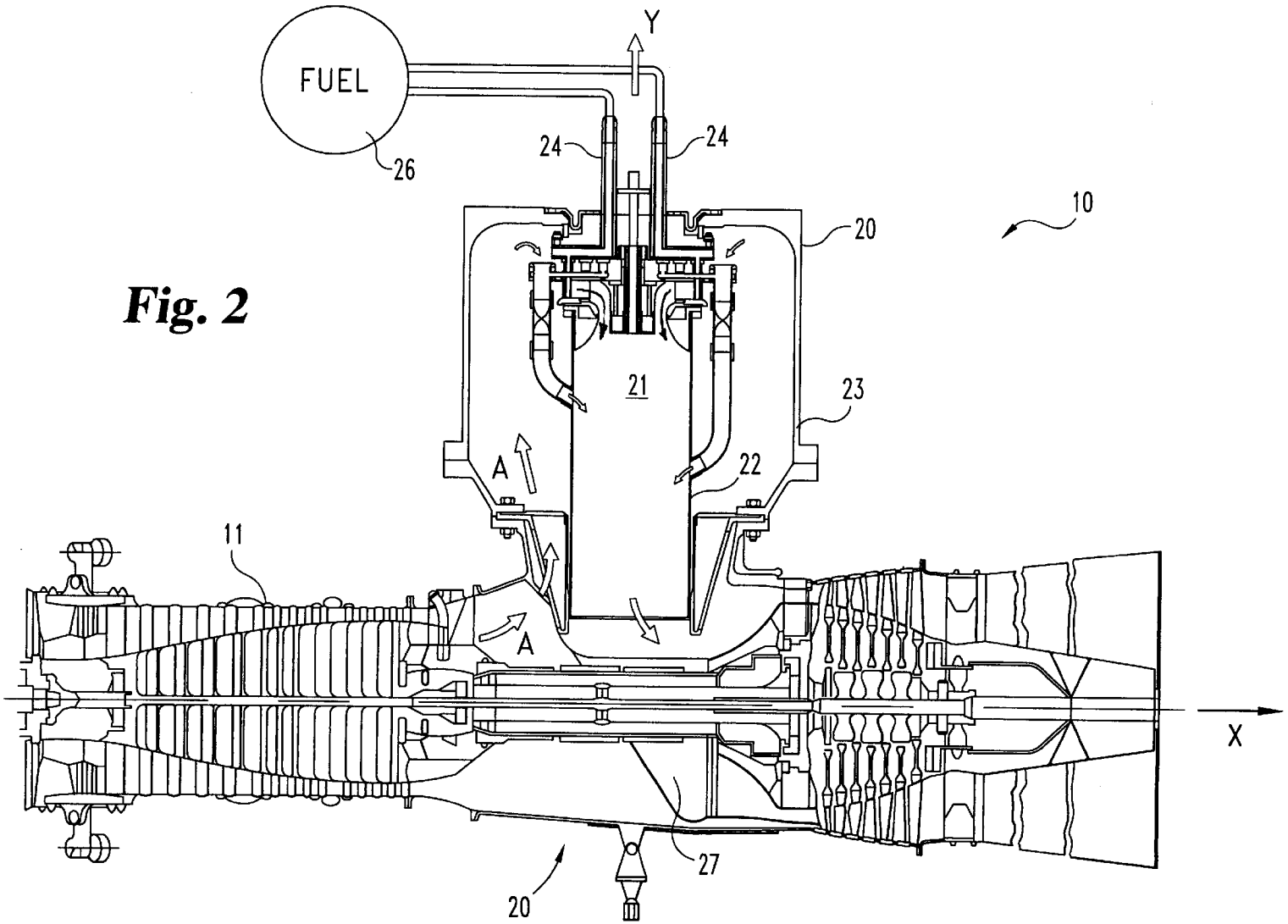
FIG. 2 is an illustrative side elevational view of an industrial gas turbine engine including a combustion system comprising one embodiment of the present invention.

With reference to FIG. 2, there is illustrated a side elevational view of an industrial gas turbine engine 10 which includes at least one dry, low emission silo combustor module 20. Preferably, the present invention relates to engines having a plurality of dry low emission silo combustor modules 20. In one form of the present invention the engine includes between 3 and 10 modules. However, the number of modules utilized will generally be selected to meet the system design parameters. In one form of the gas turbine engine 10, the silo combustor modules 20 are located off the centerline X of the engine, and the centerline Y of the silo combustor module 20 is substantially orthogonal to the centerline X of the engine. In another form of the present invention, the silo combustor modules 20 are oriented at other angles of inclination to the centerline X of the engine. The description set forth herein is focused on the silo combustor modules and associated methods of operation and will not focus upon the interaction with the remainder of the gas turbine engine.

The compressor section 11 increases the pressure of the inlet air and a portion of the air is directed into the silo combustor module 20 as indicated by the arrows "A". The pressurized air is introduced into the internal volume 21 of the combustion chamber 22. The silo combustor module 20 includes a mechanical housing 23 that surrounds the combustion chamber 22 and is coupled to the gas turbine engine 10. A plurality of fueling lines 24 is connected to a fuel source 26. In one form of the present invention the fuel is a natural gas, however other fuels including low energy gaseous fuels and liquid hydrocarbon fuels are contemplated herein. Further, the present invention will be described in terms of utilizing air and fuel for the combustion process, however other gases than air, such as the gas turbine engine exhaust are also contemplated herein. There is no intention to limit the present invention to the utilization of air unless specifically provided to the contrary. However, in order to aid the reader the description will be set forth utilizing the term air. High temperature working fluid exits the internal volume 21 of the combustion chamber 22 and passes through a duct 27 to the turbine section. In one form the mechanical duct to integrate the flow of working fluid from the silo combustor module 20 to the gas turbine engine is contemplated as being a sheet metal construction with traditional mechanical joints and cooling techniques. The duct functions to collect the gas from each of the silo combustor modules and deliver into the annular turbine inlet. In an alternate form there is an individual duct from each silo combustor module to deliver the gas stream to the annular turbine inlet. The duct is generally shaped from a circular cross section to an annular cross section. Further, the present invention contemplates other geometry's such as but not limited to a scroll geometry.

Figure 3:
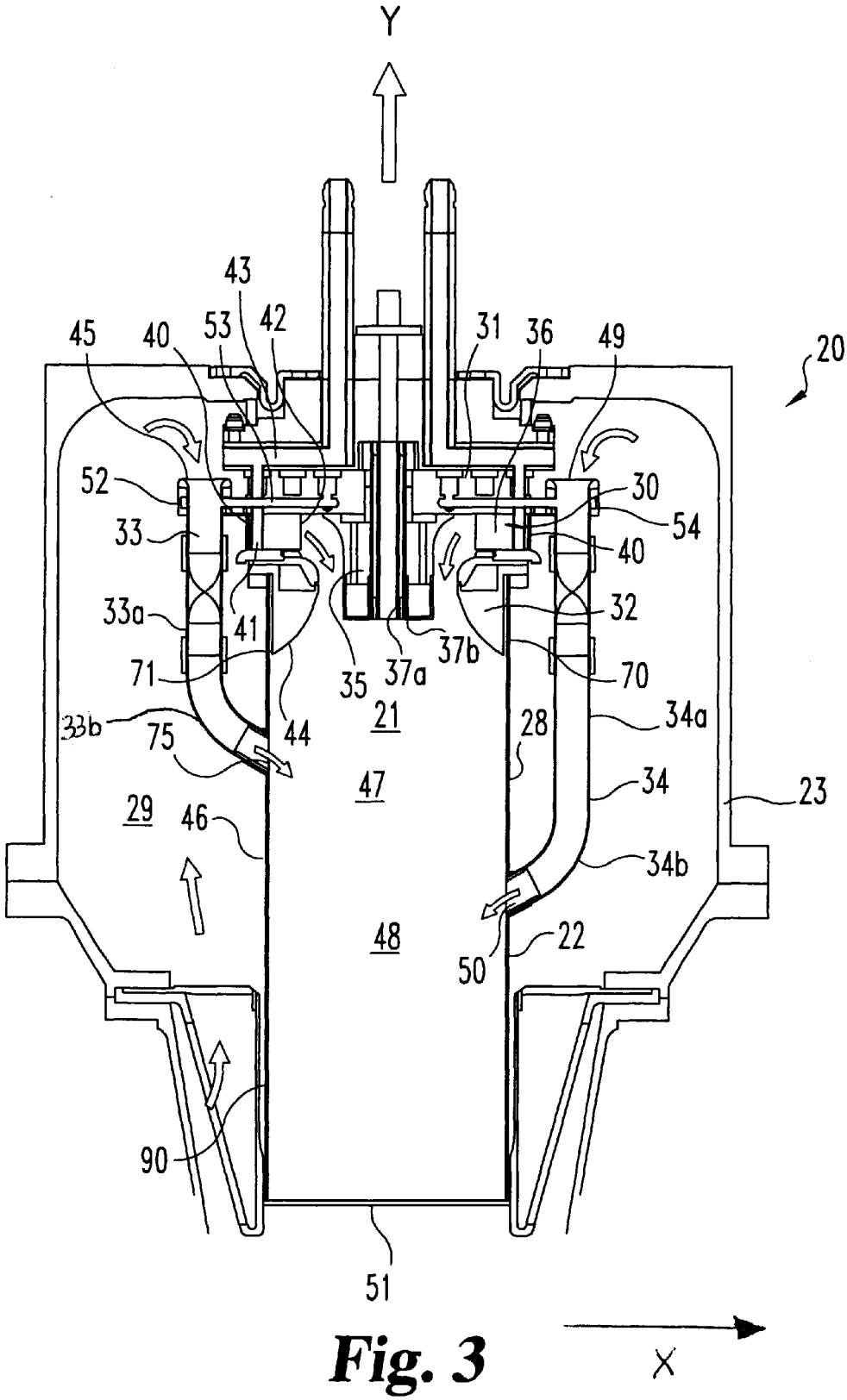
FIG. 3 is an enlarged view of the combustion system of FIG. 2.

With reference to FIG. 3, there is illustrated an enlarged view of one embodiment of the silo combustor module 20 of the present invention. Silo combustor module 20 includes the combustor assembly 28 that is disposed within the mechanical housing 23. The combustor assembly 28 is mechanically connected to the mechanical housing 23. A fluid flow passageway 29 surrounds the combustor assembly 28 and facilitates the passage of air from the compressor to the assembly 28. In one form the combustor assembly 28 includes the combustion chamber 22, a swirler 30, a fueling manifold system 31, a dome 32, at least one primary tubular premixer 33, and at least one secondary tubular premixer 34. In a preferred form of the present invention the swirler 30 is defined by a radial inflow swirler having a plurality of swirler vanes, however the present invention contemplates other swirlers, such as, but not limited to, axial flow swirlers. Further, in one embodiment of the present invention, a centerbody 35 is positioned in a space defined between the plurality of vanes 36, which comprises a portion of the radial inflow swirler 30. The centerbody 35 is utilized to control the swirler core flow from the radial inflow swirler. It is understood that the actual position of the centerbody 35 may be changed to adjust the flame structure, burning rate and noise associated therewith. In one embodiment, the centerbody 35 includes an igniter 37*a* and a pilot fuel injector 37*b*. Alternate embodiments of the present invention contemplate that some of the above components may not be utilized in a particular design The air from the compressor flows through the passageway 29 around the combustor assembly 28 and enters into the radial inflow swirler 30 through a radial inflow swirler inlet 40. Radial inflow swirler inlet 40 is distributed circumferentially around the radial inflow swirler 30 and allows the passage of the air into the swirler 30 and between the plurality of vanes 36. A plurality of fuel dispensers 41 extend along the axial length of the plurality of vanes 36. Each of the plurality of fuel dispensers 41 have a plurality of fuel discharge openings to dispense fuel into the air flowing in the channels defined between the plurality of vanes 36. The air and fuel is mixed within the radial inflow swirler 30 as it passes between the plurality of vanes 36 and the mixture passes out of the radial inflow swirler 30 at outlet 42. The present application contemplates that the terms mixing and mixture contemplate a broad meaning that includes partial and/or complete mixing. In one form the discharged mixture of fuel and air from the swirler 30 has a mono-directional swirl as it passes into the internal volume 21 of the combustion chamber 22. In one form of the present invention the mixture swirls in a clockwise direction as it exits the swirler as viewed from top of the combustor looking downstream. The present invention contemplates that the swirl direction can be clockwise or counterclockwise. Fuel is delivered to the plurality of fuel dispensers 41 by a manifolding system 43.

The fuel and air mixture from the radial inflow swirler 30 passes into the internal volume 21 of the combustion chamber 22 in a mono-directional swirling flow. The air and fuel flow passes over a contoured dome 32 that extends between the radial inflow swirler 30 and the combustion chamber 22. In one embodiment of the present invention an annular flow path is defined between the centerbody 35 and the dome 44. In one form of the present invention the outer surface 44 of the dome 32 has a geometric shape designed to minimize the flow separation of the fuel and air mixture leaving the radial inflow swirler 30 and entering the combustion chamber 22. In one embodiment, the outer surface 44 has a convex configuration, and in a more preferred form, the flow path converges and then diverges utilizing a geometric configuration defined by a quarl. The dome 32 has the outer surface defined on an annular ring that extends into the internal volume 21. In one form the dome 32 has an annular wall memebr 70 that is spaced from the wall of the combustion chamber 22. A space 71 is defined between the wall of the combustion chamber 22 and the dome 32. The space 71 provides an insulating environment and allows for the compensation for differentials in thermal expansion. In one form of the present invention the centerbody 35 is spaced from and extends along a portion of the dome 44.

The plurality of primary tubular premixers 33 have an inlet end 45 adapted to allow the passage of air into the tubular premixers 33. In one form of the present invention there are between 3 and 6 primary tubular premixers, however the present invention also contemplates other quantities outside of this range Primary tubular premixers 33 are coupled to and extend along the combustion chamber 22 and are adapted to deliver a mixture of fuel and air into the internal volume 21 of the combustion chamber 22 through an outlet 46. In one form of the present invention the plurality of primary tubular premixers 33 are spaced circumferentially around the outside of the combustion chamber, and in a more preferred form are evenly spaced. The tube of the primary tubular premixer includes a substantial portion 33*a* that extends parallel to a centerline of the combustion chamber 22. A secondary portion 33*b* forms a curved piece that couples to the combustion chamber's wall. The combustion chamber 22 includes a plurality of openings 75 defined in the combustion chamber wall and adapted to receive the discharge from outlet 46.

Fluid passing through the plurality of primary tubular premixers 33 enters the internal volume 21 in a substantially radial direction. In a preferred form of the present invention the primary tubular premixers include a mechanical mixer within its flow passageway. Each of the plurality of primary tubular premixers 33 delivers the fuel and air mixture into the internal volume 21 at a location such that the discharged jets of fuel and air interact with the swirling flow of fuel and air from the radial inflow swirler 30. It is preferred that the fuel and air mixture delivered from each of the primary tubular premixers have a significant radial direction component. Further, in one form of the present invention the flow of fuel and air from the plurality of primary tubular premixers is at least fifteen percent of the fuel and air flow from the swirler. In a preferred form of the present invention, the interaction of the swirling fuel and air from the radial inflow swirler 30 and the jets of fuel and air from the primary tubular premixers 33 interact within the primary burning region 47 of the internal volume 21. The fuel and air is ignited and burned within the internal volume 21. In one embodiment of the present invention the plurality of primary tubular premixers have there discharge located on the combustion chamber at a location spaced axially from the dome a distance of about one half of the diameter of the combustion chamber.

The internal volume 21 of the combustion chamber 22 includes a secondary burning region 48 which is axially spaced from the primary burning region 47. A plurality of secondary tubular premixers 34 have an inlet 49 for receiving the air that passes through passageway 29. In one form of the present invention there are between 6 and 9 secondary tubular premixers, however the present invention also contemplates other quantities outside of this range. The secondary tubular premixers 34 include a passageway extending from the inlet 49 to an outlet 50 that discharges a jet of fuel and air into the internal volume 21 of the combustion chamber 22. In one form of the present invention the plurality of secondary tubular premixers 34 are spaced circumferentially around the outside of the combustion chamber 22, and in a preferred form are evenly spaced. The tube of the secondary tubular premixer 34 includes a substantial portion 34*a* that extends parallel to the centerline Y of the combustion chamber 22. A secondary portion 34*b* forms a curved piece connecting to the combustion chamber wall. Each of the discharge jets from the plurality of secondary tubular premixers 34 is discharged into the secondary burning region 48 and includes a significant radial direction component. In a preferred form each of the secondary tubular premixers include a mechanical premixer within its flow path. In one embodiment the plurality of secondary tubular premixers define an air and fuel flow that is within a range of about 20 percent to about 40 percent of the total flow within the combustion chamber. The hot gaseous flow continues through the combustion chamber 22 and is discharged out the end 51. In one form of the present invention, a fueling manifold 52 fuels the plurality of primary tubular premixers 33. The fueling manifold 52 discharges fuel through a plurality of openings in the wall member of the tube. In a preferred form of the present invention the fueling profile has a concentration that is heaviest between the wall member of the tube and the centerline of the passageway. The fuel manifold 52 is fed by fueling system 53.

The secondary tubular premixers 34 include a fueling manifold 54 for discharging fuel through a plurality of openings in the wall member of the tube and into the fluid flow passageway in the tube. The fueling manifold 54 is connected to a fuel system 55 for the delivery of fuel. In a preferred form of the present invention, the primary tubular premixers 33, secondary tubular premixers 34, and the radial inflow swirler 30 are fueled independent of one another. In an alternate embodiment, the radial inflow swirler 30 and the primary tubular premixers 33 are fueled from the same fueling system. The present invention contemplates an alternate embodiment wherein the primary tubular premixer and/or the secondary tubular premixer include a turning vane at their outlet to direct the fluid flow passing into the combustion chamber.

In a preferred form of the present invention, a combustion liner 90 defines the combustion chamber 22. In a more preferred form of the present invention, the combustion liner 90 has a cylindrical configuration with a constant cross-sectional area extending from the inlet to the outlet. This cylindrical combustion liner 90 includes a wall member which is cooled using either back-side convention cooling or an effusion cooling technique. Both of these designs are generally well known to people skilled in the art, and U.S. Pat. No. 5,289,686 to Razden provides added details thereon and is incorporated herein by reference. In one form of the present invention, the effusion cooled wall members include several thousand, small diameter holes. The plurality of small effusion cooling holes has not been illustrated in order to simplify the understanding of the present invention. Further, in an alternate embodiment the inside surface of the combustion liner may be coated with a thermal barrier coating.

Figure 4:
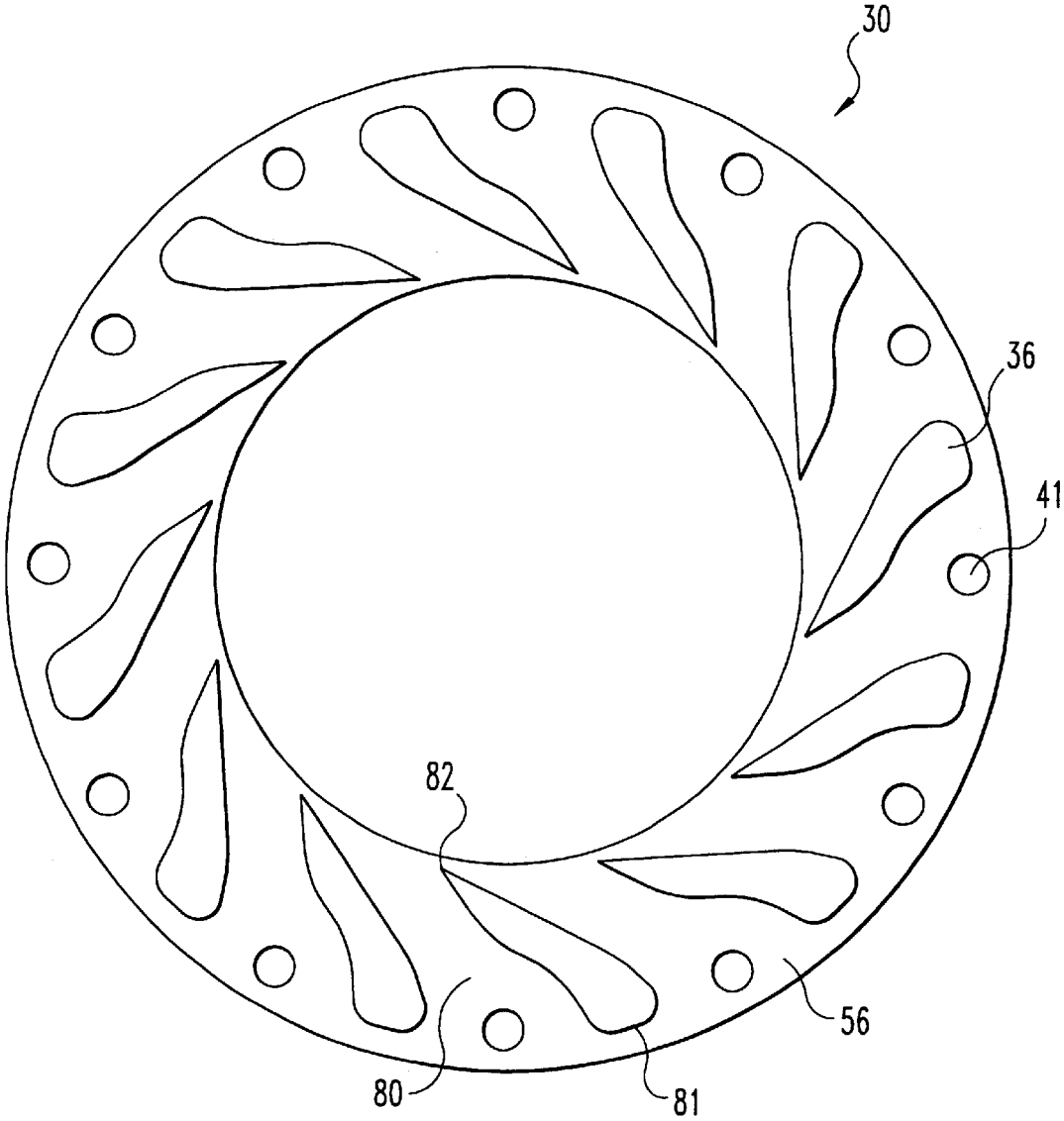
FIG. 4 is an end view of one form of the radial swirler comprising a portion of the combustion system of FIG. 2.

With reference to FIG. 4, there is illustrated an end view of the radial inflow swirler 30. Radial inflow swirler 30 includes the plurality of swirler vanes 36 and the plurality of fuel dispensers 41. In one embodiment of the present invention, the radial inflow swirler 30 includes twelve vanes 36 that are spaced equally around the circumference of the swirler and are connected between two end plates 56. However, swirlers having other quantities of vanes and spacing are contemplated herein. Vanes 36 are joined to the end plate 56 by commonly known assembly techniques such as brazing. In an alternate embodiment there is contemplated that the vane 36 is integrally formed with the end plate by machining. The vanes 36 are preferably inclined at an angle. The swirl angle of the fuel and air passing from the radial inflow swirler is defined as the $\tan^{-1}$ (azimuthal velocity/axial velocity) at the throat of the radial inflow swirler, which is defined at the radial inflow premixer discharge plane. Preferably the present invention has increased degrees of swirl and in a more preferred form of the present invention the swirl angle is within a range of about 40° to about 70°. The air and fuel flowing between the plurality of vanes 36 flows in channels 80 defined between the vanes and the end plates. Each of the vanes 36 include a leading edge 81, a trailing edge 82 and a surface extending in the streamwise and spanwise directions. The vanes are preferably constructed of alloyed steel which is capable of withstanding compressor dischage temperature levels. One form of the present invention contemplates stainless steel, but other materials are contemplated herein.

Figure 5:
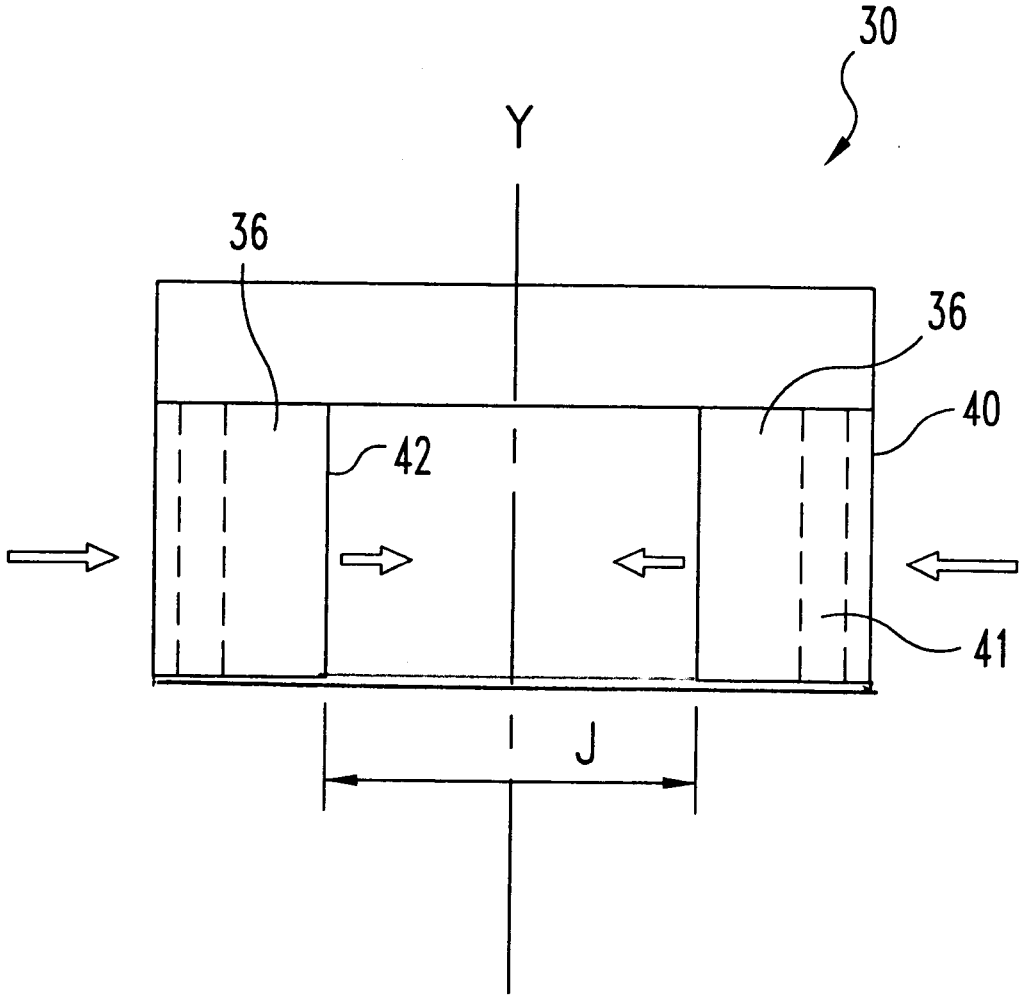
FIG. 5 is an illustrative view of one embodiment of a premixer module comprising one form of the present invention.

With reference to FIG. 5, there is illustrated a schematic view of a portion of the radial inflow swirler 30. The schematic diagram illustrates the relationship between the radial inflow swirler inlet 40, the plurality of vanes 36, and the fuel dispensers 41. The fuel and air passes through the channels 80 defined between the plurality of vanes 36 and out of the system at outlet 42. The arrow "J" in FIG. 5, illustrates the cross-sectioanl area taken at the discharge of the radial inflow swirler. The term expansion ratio as utilized herein defines a ratio where the cross-sectional area of the internal volume of the combustion chamber is divided by the cross-sectional area taken at the discharge of the radial inflow swirler. In a preferred form of the present invention the discharge plane is located at the throat of the dome quarl, which is the location of smallest diameter.

Figure 6:
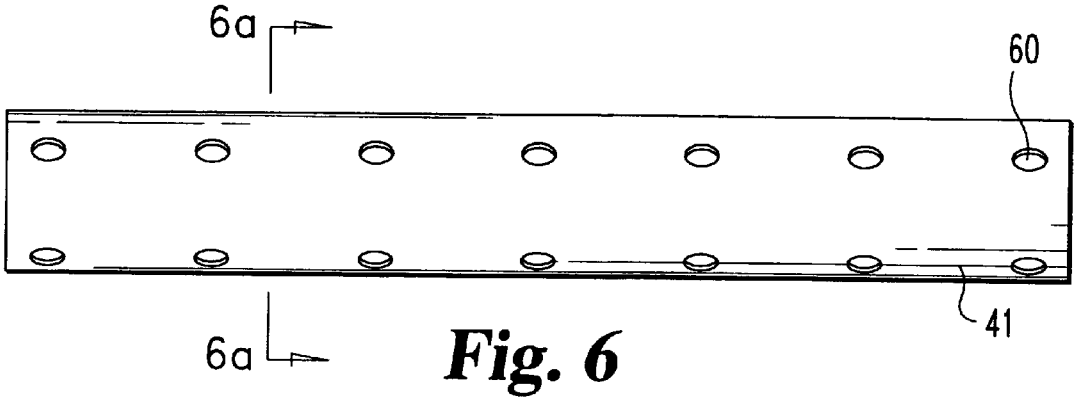
FIG. 6 is a side elevational view of a fuel tube comprising a portion of the premixer module of FIG. 3.
Figure 6A:
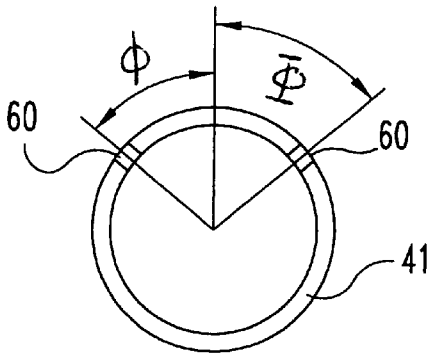
FIG. 6*a* is a cross sectional view of the fuel tube of FIG. 6, taken along line 6—6 of FIG. 6.

With reference to FIG. 6, there is illustrated one embodiment of the fuel dispenser 41. In one form of the present invention, the fuel dispenser 41 is defined by a tube having a plurality of fuel dispensing holes 60 that are located and oriented to create the desired fuel concentration profile across the radial inflow swirler. It is also understood that in an alternative embodiment of the present invention, the fuel dispenser 41 could be integrally formed with the plurality of vanes in the system. The present invention contemplates that the fuel dispensing holes 60 preferably have a size within a range of about 0.020 inches to about 0.080 inches. Further, the fuel dispensing holes are laterally spaced between about 0.125 inches and about 0.500 inches. The fuel dispensing holes 60 are oriented on an included angle that is preferably within a range of about 90° to about 180°. In one more preferred form of the present invention the fuel dispensing holes 60 have a diameter of 0.042 inches, are spaced axially 0.250 inches and are set at an included angle of 135°. The included angle includes angle $\phi$ and angle $\Phi$, and in the one form angles $\phi$ and angle $\Phi$ are unequal. In a preferred form angle $\phi$ is about 79° and angle $\Phi$ is about 56°. It is understood that the present invention contemplates other fuel dispensing hole sizes, spacing and angles of inclusion.

Figure 7:
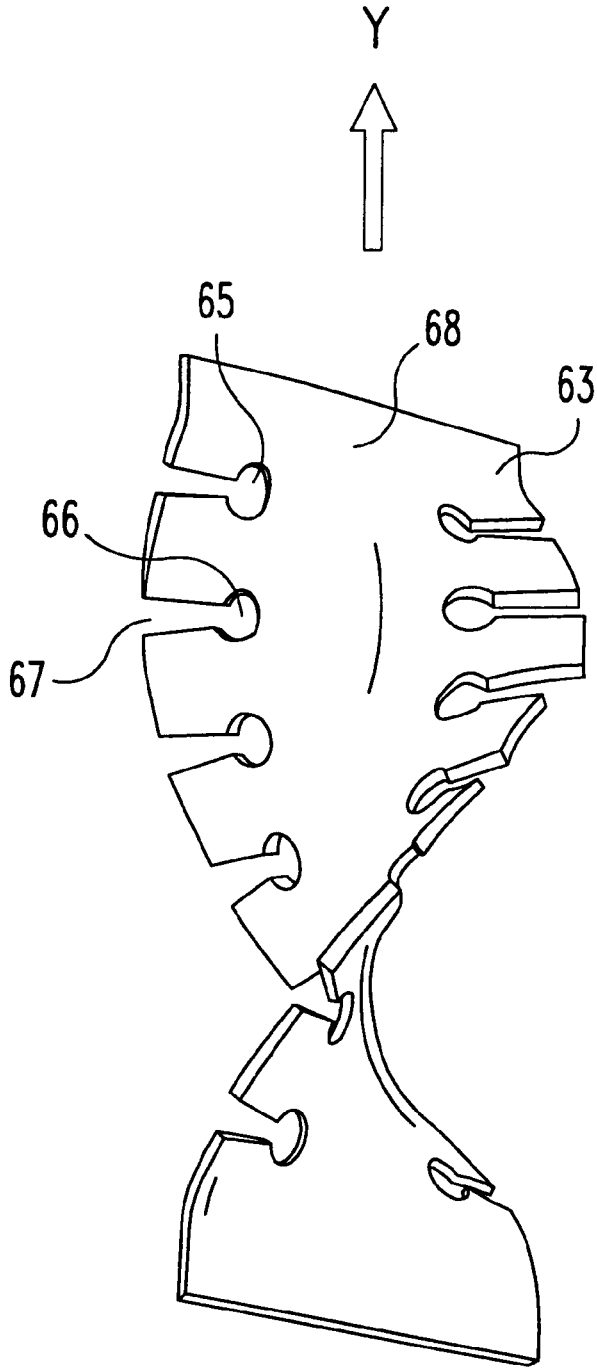
FIG. 7 is a perspective view of a twist mixer comprising a portion of the primary and secondary tubular premixers of FIG. 3.

With reference to FIG. 7, there is illustrated an enlarged view of the twist mixer of the present invention. In one embodiment of the present invention the twist mixer is positioned within the flow path of the primary tubular premixer and/or the secondary tubular premixer to mix the entire flow within each of their passageways to provide enhanced mixing. The enhanced mixing associated with the twist mixer is related to secondary flow mechanisms without flow recirculation that could lead to pre-ignition or flash-back. The twist mixer 63 is formed from a sheet material and has a plurality of key openings 65 formed therein. Key openings 65 have a substantially circular portion 66 and a truncated triangular shape 67. The main body member 68 is then twisted about a longitudinal centerline Z through 180°. The twisting is substantially uniform along the longitudinal axis Z. In one form of the present invention the main body member is a plate of about 0.030 inches in thickness, about 2.9 inches long and about 0.9 inches wide. However, a main body member having other dimensions is contemplated herein. Further, the present invention contemplates that each of the primary tubular premixers and/or the secondary tubular premixers can utilize a different type of mixing device.

Figure 8:
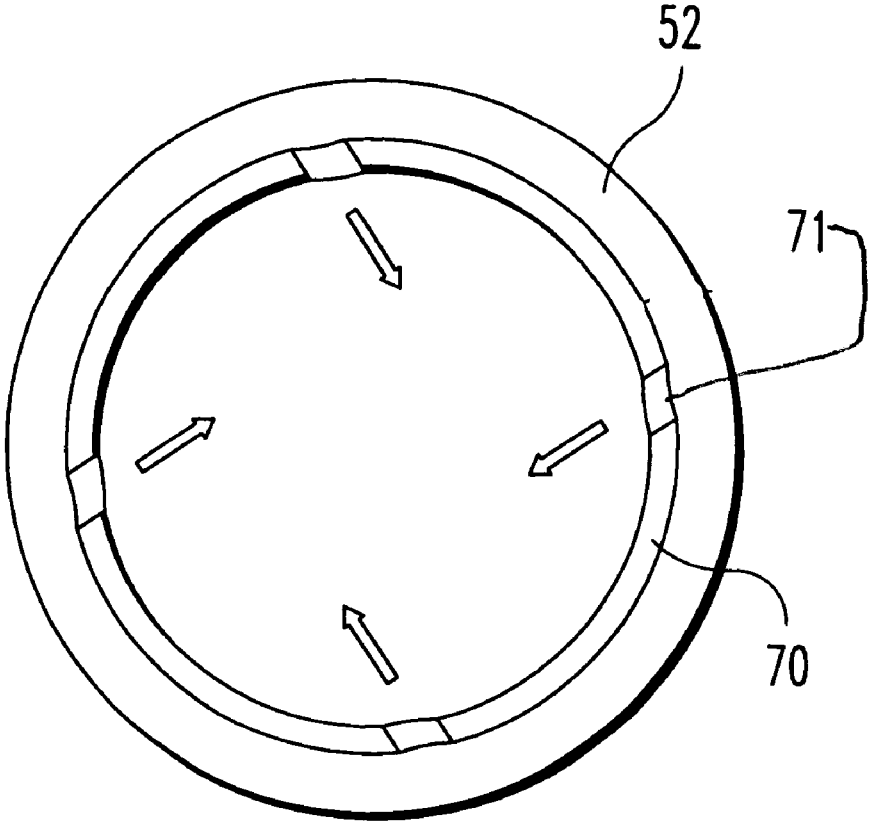
FIG. 8 is an sectional view of a fuel dispensing system comprising a portion of the primary and secondary tubular premixers of FIG. 3.

With reference to FIG. 8, there is illustrated an enlarged schematic representation of the fueling manifold/fuel dispenser 52 for delivering fuel to the primary tubular premixer 33. The fueling manifold/fuel dispenser 52 surrounds the tube 70 defining the body of the tubular premixer 33. Located around the circumference of the tube 70 is a plurality of fuel dispensing apertures 71 that receive fuel from the fueling manifold/fuel dispenser 52. In one form the fuel dispensing apertures 71 are formed at a compound angle through the tube. The number of fuel dispensing apertures is preferably within a range of about 4 to about 8. However, other quantities of apertures and different angles of orientation are contemplated herein. The fueling manifold preferably delivers a fuel profile that is heavier between the wall and the center line. A substantially similar system is utilized in one embodiment of the present invention to deliver fuel to the secondary tubular premixers 34. The fueling manifold/fuel dispenser 54 surrounds the tube that defines the body of the secondary tubular premixer 34. Located around the circumference of the tube is a plurality of fuel dispensing discharge apertures that receive fuel from the fueling manifold/fuel dispenser 54.

In one form of the present invention the flow exiting the swirl premixer will have a high ration of swirl velocity (azimuthal velocity) to axial velocity and hence a high swirl angle. Downstream of the throat the swirler/premixer the flow will begin to expand as it flows along the contour of the dome. The force created by the high swirl velocity produces this expansion. The flow will continue to expand until reaching the combustion liner cylinder. The flow will continue along the wall of th ecombustor liner until reaching the primary jets from the plurality of primary tubular premixers. In this region the swirler flow is forced inward and collapses into the volume just downstream of the centerbody and inside the swirler annulus flow. Thus a toroidal recirculation zone is produced downstream of the swirler exit and upstream of the primary jets. This recirculation zone is at a much lower velocity allowing stable combustion to exit in the zone.

The fluid flows exiting the tubular premixers defines a tubular flow with a typical tube flow velocity profile. The jet flow will be oriented along the axis of the tubular premixer tube cross-section just upstream of the combustor liner. The flow velocity profile and jet flow orientation will be altered when turning vanes are used. In one form the jet flow will enter the combustion liner and penetrate roughly one third of the radius. Further, a portion of the primary jet flow will be entrained in thetoroidal recirculation zone produced by the swirler while the remainder will simply mix with products downstream of the recirculation zone.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. It should be understood that while the use of the word preferable, preferably or preferred in the description above indicates that the feature so described may be more desirable, it nonetheless may not be necessary and embodiments lacking the same may be contemplated as within the scope of the invention, that scope being defined by the claims that follow. In reading the claims it is intended that when words such as "a," "an," "at least one," "at least a portion" are used there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A combustor for burning a fuel and a gas mixture, comprising:

a mechanical housing;

a combustion chamber located within said mechanical housing and having a first end and a second end and an internal volume;

a radial inflow swirler located at said first end and disposed in flow communication with said internal volume, said radial inflow swirler including a plurality of first fret dispensers for delivering the fuel into the gas within said swirler and a plurality of vanes thy directing the fuel and gas flow into the internal volume to define a swirler flow; and a first plurality of circumferentially spaced fuel and gas tubular premixers connected to said combustion chamber and in flow communication with said internal volume, each of said first plurality of fret and gas tubular premixers adapted to deliver a premixed jet flow of the gas and fuel into said internal volume.

2. The combustor of claim 1, wherein said combustion chamber has a primary burning region, and wherein said radial inflow swirler and said first plurality of fuel and gas tubular premixers deliver fuel and gas into said primary burning region.

3. The combustor of claim 1, wherein each of said plurality of vanes produces an exit swirl angle within a range of about 40° to about 70°.

4. The combustor of claim 1, wherein said combustion chamber is defined by a combustion liner, and wherein each of said first plurality of fuel and gas tubular premixers has a tubular member with a flow passageway and a second fuel dispenser associated therewith, and wherein each of said second fuel dispensers is adapted to dispense fuel through a plurality of apertures in said tubular member.

5. The combustor of claim 4, wherein each of said plurality of first fuel dispensers is defined by a tube that extends along an axial length of said plurality of vanes.

6. The combustor of claim 1, wherein said plurality of first fuel dispensers and said first plurality of fuel and gas tubular premixers are fueled independent of one another.

7. The combustor of claim 1, which further includes a second plurality of fuel and gas tubular premixers connected to said combustion chamber and in flow communication with said internal volume; and wherein each of said second plurality of fuel and gas tubular premixers delivers a premixed jet flow of the gas and fuel into said internal volume;

wherein said combustion chamber includes a primary burning region in a first portion of said combustion chamber and a secondary burning region in a second portion of said combustion chamber; and wherein said first plurality of fuel and gas tubular premixers deliver fuel and gas into said primary burning region, and said second plurality of fuel and gas tubular premixers delivers fuel and gas into said secondary burning region, and wherein said secondary burning region is axially spaced from said primary burning region;

and wherein the gas is air.

8. The combustor of claim 1, wherein said radial inflow swirler discharges a swirling flow of fuel and gas, and wherein said first plurality of fuel and gas tubular premixers discharges a plurality of jet flows of fuel and gas that is at least 15% of said swirling flow.

9. The combustor of claim 1, wherein each of said first plurality of fuel and gas tubular premixers delivers a fuel and air jet having a significant radial inward direction.

10. A combustor, comprising:

a mechanical housing;

a combustion chamber disposed within said mechanical housing and having a first end and a second end and an internal volume;

a premixer coupled to said first end of the combustion chamber and in flow communication with said internal volume, said premixer including a swirler that delivers a swirling how of fuel and a gas to said internal volume through said first end; and a dome positioned at said first end of the combustion chamber and extending into said internal volume, said dome having an outer surface contoured to minimize flow separation of the swirling flow of fuel and the gas passing from said premixer and into said combustion chamber.

11. The combustor of claim 10, wherein said outer surface has a geometry defined as a quart.

12. The combustor of claim 10, wherein said outer surface is formed on an annular ring that is symmetrical about a longitudinal axis.

13. The combustor of claim 10, wherein said dome includes an annular wail member located within said internal volume, said combustion chamber includes a combustion liner defining said internal volume, and wherein said annular wall member is spaced from said combustion liner.

14. The combustor of claim 10, which further includes a first plurality of fuel and gas tubular premixers in flow communication with said internal volume, wherein each of said first plurality of fuel and gas tubular premixers delivers a spray of fuel and gas into said internal volume.

15. The combustor of claim 14, which further includes a second plurality of fuel and gas tubular premixers in flow communication with said internal volume, and wherein each of said first plurality of fuel and gas tubular premixers has a first entrance into said combustion chamber, and each of said second plurality of fuel and gas tubular premixers has a second entrance into said combustor chamber, and wherein said first entrance is axially offset from said second entrance.

16. The combustor of claim 15, wherein said internal volume has a diameter and wherein each of said first entrances is axially spaced from said dome a distance of about ½ of said diameter.

17. The combustor of claim 10, wherein said internal volume is cylindrical, and a ratio of the cross-sectional area of the internal volume to the cross-sectional area defined by the smallest diameter of the quarl dome is greater than or equal to 2.75.

18. The combustor of claim 17, wherein said premixer further includes a center body positioned between said plurality of vanes.

19.The combustor of claim 10, wherein said outer surface having a convex cross-section.

20. The combustor of claim 10, wherein said dome is symmetrical about a longitudinal centerline and extends axially within a portion of said internal volume.

21. The combustor of claim 10, wherein said swirler is a radial inflow swirler including a plurality of swirler vanes, and wherein said combustion chamber includes a combustion liner defining said internal volume, and wherein said internal volume is cylindrical, and which further includes a centerbody positioned in a space between the plurality of swirler vanes and said centerbody is spaced from and extends along a portion of said dome.

22. A gas turbine engine combustor, comprising:

a cylindrical combustor chamber having a first end, a second end and an internal volume, said combustor chamber having a portion with a constant cross-sectional area, said combustor chamber having a plurality of first apertures in said portion and a plurality of second apertures in said portion, and said plurality of first apertures are axially spaced from said plurality of second apertures;

a plurality of first fuel and gas tubular premixers coupled to said combustor chamber, each of said plurality of first fuel and gas tubular premixers in flow communication with one of said plurality of first apertures; and a plurality of second fuel and gas tubular premixers coupled to said combustor chamber, wherein each of said plurality of second fuel and gas tubular premixers in flow communication with one of said plurality of second apertures.

23. The combustor of claim 22, wherein each of said plurality of first fuel and gas tubular premixers includes a tubular member with a fluid flow path therein, and which further includes a mechanical flow mixer within said fluid flow path.

24. The combustor of claim 23, wherein each of said plurality of second fuel and gas tubular premixers includes a tubular member with a flow path therein, and which further includes a mechanical flow mixer within said flow path.

25. The combustor of claim 22, wherein said cylindrical combustor chamber is defined by a combustor liner, and which further includes a first fueling manifold adapted fin providing fuel to said plurality of first fuel and gas tubular premixers and a second fueling manifold adapted for providing fuel to said plurality of second fuel and gas tubular premixers, and wherein said plurality of first fuel and gas tubular premixers and said plurality of second fuel and gas tubular premixers are independent of one another.

26. The combustor of claim 22, wherein said internal volume has a primary combustion region and a secondary combustion region axially spaced from said primary combustion region, and wherein said plurality of first apertures is formed in said portion in a first region associated with said primary combustion region and said plurality of second apertures is formed in said portion in a second region associated with said secondary combustion region.

27. The combustor of claim 22, wherein said plurality of first fuel and gas tubular premixers and said plurality of second fuel and gas tubular premixers include at least one discharge turning vane to turn a flow of fuel and air passing into said internal volume.

28. A combustor, comprising:

a mechanical housing;

a combustion chamber located within said mechanical housing and having an internal volume; and a premixer coupled with said combustion chamber, said premixer comprising:

a tubular member having a first end and a second end and a flow passageway therebetween;

a fuel manifold disposed in fluid communication with said flow passageway for the delivery of a fuel into said flow passageway; and twist mixer means for rotating the fluid flowing within said flow passageway, said twist mixer means positioned within said flow passageway.

29. The combustor of claim 28, wherein said first end is an inlet adapted for receiving a flow of gas and said second end is an outlet adapted for discharging ii flow of the gas and fuel, and wherein said tubular member includes a plurality of apertures for the passage of fuel from said fuel manifold into said flow passageway.

30. The combustor of claim 29, wherein said plurality of apertures is circumferentially spaced around said tubular member.

31. The combustor of claim 28, wherein said twist mixer in located in said flow passageway downstream from said fuel manifold, and wherein said twist mixer includes a plate number twisted about a longitudinal axis.

32. The combustor of claim 31, wherein said plate member includes a that end and a second end, and said second end is rotated about 180 degrees from said first end.

33. The combustor of claim 29, wherein said twist mixer rotates the entire flow within the passageway.

34. The combustor of claim 1, wherein a radial inflow swirler defines only one swirler having said swirler flow, the swirler flow is only in one of a clockwise and counterclockwise direction.

35. The combustor of claim 1, which further includes a plurality of second fuel dispensers, wherein each of said first plurality of fuel and gas tubular premixers includes a first fluid flow passageway in flow communication with one of said second fuel dispensers, and wherein said second fuel dispensers do not obstruct said first fluid flow passageways.

36. The combustor of claim 22, wherein said plurality of first fuel and gas tubular premixers are circumferentially spaced.

37. The combustor of claim 22, wherein said plurality of second fuel and gas tubular premixers are circumferentially spaced.

38. At A combustor for burning a fuel and a gas mixture, comprising:

a mechanical housing;

a combustion chamber located within said mechanical housing and having a first end and a second end and an internal volume, said internal volume including a first burning zone and a second burning zone;

a radial billow swirler portion located at said first end and in fluid communication with said internal volume, said swirler portion including a plurality of first fuel dispensers for delivering the fuel into the gas within said swirler portion, said swirler portion includes a plurality of vanes for swirling the fuel and gas into a swirled flow having only one of a clockwise and counterclockwise direction;

a done positioned at said first end and extending into said internal volume, said dome configured to gradually expand the swirled flow received from said swirler portion as it moves adjacent an outer surface of said dome;

a center body positioned within a space defined between said plurality of vanes;

a first plurality of circumferentially spaced fuel and gas tubular premixers connected to said combustion chamber and in flow communication with said internal volume, each of said first plurality of fuel and gas tubular premixers adapted to deliver a premixed jet flow of the gas and fuel into said internal volume to interact with the swirled how from said radial inflow swirler portion; and a second plurality of circumferentially spaced hid and gas tubular premixers connected to said combustion chamber and in flow communication with said internal volume, each of said second plurality of fuel and gas tubular premixers adapted to deliver a premixed jet flow of the gas and fuel into said second burning zone.

* * * * *

UNITED STATES PATENT AND TRADEMARK OFFICE

CERTIFICATE OF CORRECTION

PATENT NO. : 6,691,515 B2
DATED : February 17, 2004
INVENTOR(S) : Albert J. Verdouw et al.

It is certified that error appears in the above-identified patent and that said Letters Patent is hereby corrected as shown below:

Colum 10,
Lines 35 and 42, please change “fret” to -- fuel --.
Line 36, please change “thy” to -- for --.

Column 11,
Line 42, please change “quart” to -- quarl --.

Column 12,
Line 51, please change “fin” to -- for --.

Column 13,
Line 20, please change “ii” to -- a --.
Line 32, please change “that” to -- first --.

Column 14,
Line 7, please delete “At”.
Line 11, please continue paragraph after “first”.
Line 23, please change “done” to -- dome --.
Line 36, please change “how” to -- flow --.
Line 38, please change “hid” to -- fuel --.

Signed and Sealed this

Fifteenth Day of June, 2004

JON W. DUDAS
*Acting Director of the United States Patent and Trademark Office*